US007106291B2

(12) United States Patent
Yoon

(10) Patent No.: US 7,106,291 B2
(45) Date of Patent: Sep. 12, 2006

(54) LIQUID CRYSTAL DISPLAY AND DRIVING METHOD THEREOF

(75) Inventor: Jeong Hun Yoon, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 337 days.

(21) Appl. No.: 10/293,611

(22) Filed: Nov. 14, 2002

(65) Prior Publication Data

US 2003/0122765 A1 Jul. 3, 2003

(30) Foreign Application Priority Data

Dec. 27, 2001 (KR) ..... 2001-86140

(51) Int. Cl.
*G09G 3/36* (2006.01)

(52) U.S. Cl. ..... 345/98; 345/100

(58) Field of Classification Search ..... 345/87–103, 345/208, 210–212
See application file for complete search history.

(56) References Cited

U.S. PATENT DOCUMENTS 5,587,722 A * 12/1996 Suzuki et al. ..... 345/94
5,995,075 A * 11/1999 Vignolle ..... 345/94

FOREIGN PATENT DOCUMENTS

WO WO 9604640 A1 * 2/1996

* cited by examiner

*Primary Examiner*—Xiao Wu
(74) *Attorney, Agent, or Firm*—Birch, Stewart, Kolasch & Birch, LLP

(57) ABSTRACT

A liquid crystal display and a driving method thereof that is adaptive for improving picture quality. In the method, video signals are applied to a plurality of data lines connected to the liquid crystal cells. At least one gate pulse having a desired falling slope is sequentially applied to a plurality of gate lines connected to the liquid crystal cells in a direction crossing the data lines.

16 Claims, 8 Drawing Sheets

LIQUID CRYSTAL DISPLAY AND DRIVING METHOD THEREOF

This nonprovisional application claims priority under 35 U.S.C. § 119(a) on patent application Ser. No. 2001-0086140 filed in Korea on Dec. 27, 2001, which is herein incorporated by reference.

BACKGROUND OF THE INVENTION

1. Field of the Invention

The present invention relates to a liquid crystal display, and more particularly to a liquid crystal display and a driving method thereof that is adaptive for improving picture quality.

2. Description of the Related Art

Generally, a liquid crystal display (LCD) uses a pixel matrix arranged at intersections between gate lines and data lines to display a picture corresponding to video signals. Such a pixel consists of a liquid crystal cell controlling a transmitted light amount in accordance with a video signal, and a thin film transistor (TFT) for switching a video signal to be applied from the data line to the liquid crystal cell.

When a gate pulse is sequentially applied to the gate lines, a video signal is applied to the data lines. At this time, a desired voltage is supplied to a liquid crystal cell to which the gate pulse and the video signal are applied simultaneously, and a liquid crystal is driven with this voltage to thereby display a picture corresponding to the video signal. However, in such a conventional LCD, a charged voltage is differentiated depending upon a position of the liquid crystal cell.

In other words, when the same video signal is applied, a certain voltage Vg1 is charged in the liquid crystal cell positioned at an intersection between the first gate line GL1 and the first data line DL1 as shown in FIG. 1 and FIG. 2A. Otherwise, a voltage Vg2 lower than the certain voltage Vg1 is charged in the liquid crystal cell 4 positioned at an intersection between the first gate line GL1 and the nth data line DLn as shown in FIG. 2B.

As described above, in the conventional LCD, a voltage charged depending upon a position of the liquid crystal cell is differentiated due to a resistance voltage of the gate line GL and a capacitance value of the liquid crystal cell. Particularly, since such a phenomenon becomes more serious as LCDs move toward larger screens and a high resolution, picture quality of the LCD is deteriorated. In order to solve this problem, there has been suggested a driving method as shown in FIG. 3.

FIG. 3 shows a method of driving another conventional LCD.

Referring to FIG. 3, gate lines GL of another conventional LCD are supplied with two gate pulses GP1 and GP2. At one gate line GL, a first gate pulse GP1 is applied in such a manner so as to be synchronized with an nth horizontal synchronizing signal H while a second gate pulse GP2 is applied in such a manner to be synchronized with a (n+2)th horizontal synchronizing signal H.

In operation, when the second gate pulse GP2 is applied to the first gate line GL1, the first gate pulse GP1 is applied to the third gate line GL3. At this time, a certain voltage corresponding to a video signal is charged in the first gate line GL1. On the other hand, a voltage corresponding to the video signal at the first gate line GL1 is pre-charged in the third gate line GL3 supplied with the first gate pulse GP1.

For instance, if the second gate pulse Gp2 is applied to the first gate line GL1, then a voltage of 5V is pre-charged in the liquid crystal cells provided along the third gate line GL3 when a video signal having a voltage of 5V is supplied. Thereafter, if the second gate pulse GP2 is applied to the third gate line GL3, then only a voltage of 2V is charged in the liquid crystal cells provided along the third gate line GL3. In other words, in another conventional LCD driving method, when the first gate pulse GP1 is applied to the nth gate line GLn, a voltage corresponding to a video signal applied to the (n−2)th gate line GLn−2 is pre-charged, thereby charging a desired voltage irrespectively of the location of the liquid crystal cell.

FIG. 4 represents a gate driver for generating the gate pulse shown in FIG. 3.

Referring to FIG. 4, the conventional gate driver includes an OR gate 12 and a driver integrated circuit 14, hereinafter referred to as "D-IC". Herein, a gate shift clock GSC is a signal for determining a time when the gate of the TFT is turned on or off. The gate start pulse GSP is a signal for indicating the first driving line of the field in one vertical synchronizing signal.

Flip-flops 6, 8 and 10 receive a gate shift clock signal GSC as shown in FIG. 6. When the liquid crystal display panel is driven, the gate start pulse GSP is inputted to the first flip-flop 6. The gate start pulse GSP inputted to the first flip-flop 6 is shifted into the second flip-flop 8 when the gate shift clock GSC is inputted. At this time, the gate start pulse GSP shifted into the second flip-flop 8 is applied to the OR gate 12. The gate start pulse GSP inputted to the OR gate 12 is applied to the D-IC 14.

Meanwhile, the gate start pulse GSP applied to the second flip-flop 8 is shifted into the third flip-flop 10 when the gate shift clock signal GSC is inputted. Further, the gate start pulse GSP applied to the third flip-flop 10 is applied to the OR gate 12 when the gate shift clock signal GSC is inputted. In other words, two gate start pulses GSP are inputted to the OR gate 12 at a desired time difference (i.e., one period of the gate shift clock signal GSC). Thus, the OR gate 12 applies two gate start pulse GSP2 to the D-IC 14 as shown in FIG. 6.

As shown in FIG. 5, the D-IC 14 includes an inverter 16 supplied with a gate output enable signal GOE, an AND gate 18 supplied with an output signal of the inverter 16 and two gate start pulse GSP2, and first and second switching devices SW1 and SW2 controlled by an output signal of the AND gate 18. The first switching device SW1 is connected to a first gate voltage source Vcc while the second switching device SW2 is connected to a second gate voltage source −Vg. Herein, the gate output enable signal GOE is a signal for controlling an output of the gate driver.

The AND gate 18 receives two gate start pulse GSP2 and a gate output enable signal GOE inverted by the inverter 16. At this time, the AND gate 18 applies a control signal of "1" to the first and second switching devices SW1 and SW2 when the gate start pulse GSP2 has a high state and when the gate output enable signal GOE passing through the inverter 16 has a high state. If a control signal of "1" is applied from the AND gate 18, then the first switching device SW1 is turned on to thereby output the first gate voltage Vcc to the gate line GL.

Thereafter, the AND gate 18 applies a control signal of "0" to the first and second switching devices SW1 and SW2 when the gate start pulse GSP2 has a low state or when the gate output enable signal GOE passing through the inverter 16 has a low state. If a control signal of "0" is applied from the AND gate 18, then the second switching device SW2 is turned on to thereby output the second gate voltage −Vg to the gate line GL. By repeating such a process, the first and second gate pulses GP1 and GP2 are sequentially outputted to the gate lines GL.

However, in another conventional LCD, when the gate pulse GP is fallen, a voltage charged in the liquid crystal cell is dropped by a voltage ΔV as shown in FIG. 7. In other words, when the gate pulse GP suddenly falls, a voltage charged in the liquid crystal cell is dropped by a voltage ΔV along the falling gate pulse GP. Accordingly, a desired voltage fails to be charged in the liquid crystal cell and hence a picture having a desired quality fails to be displayed on the LCD.

SUMMARY OF THE INVENTION

Accordingly, it is an object of the present invention to provide a liquid crystal display and a driving method thereof that is adaptive for improving picture quality.

In order to achieve these and other objects of the invention, a method of a liquid crystal display according to one aspect of the present invention includes the steps of applying video signals to a plurality of data lines connected to the liquid crystal cells; and sequentially applying at least one gate pulse having a desired falling slope to a plurality of gate lines connected to the liquid crystal cells in a direction crossing the data lines.

In the method, said gate pulse includes the steps of rising from a first voltage into a second voltage; remaining at said second voltage; falling from said second voltage into a third voltage higher than said first voltage at a desired slope; and falling from said third voltage into said first voltage.

First and second gate pulses are applied to the gate lines in such a manner so as to be spaced by one horizontal period.

Herein, the second gate pulse applied to the nth gate line (wherein n is an integer) and the first gate pulse applied to the (n+2)th gate line are applied at the same time.

A method of driving a liquid crystal display according to another aspect of the present invention includes the steps of applying video signals to a plurality of data lines connected to the liquid crystal cells; applying a first gate pulse having a desired falling slope to any one of a plurality of gate lines connected to the liquid crystal cells in a direction crossing the data lines; and applying a second gate pulse having a rectangular waveform to the gate line supplied with the first gate pulse in such a manner so as to be spaced by one horizontal period from the first gate pulse.

In the method, the first gate pulse applied to the nth gate line (wherein n is an integer) and the second gate pulse applied to the (n+2)th gate line are applied at the same time.

Said first gate pulse includes the steps of rising from a first voltage into a second voltage; remaining at said second voltage; falling from said second voltage into a third voltage higher than said first voltage at a desired slope; and falling from said third voltage into said first voltage.

A liquid crystal display according to still another aspect of the present invention includes a pulse voltage generator for receiving a gate shift clock signal to generate at least one gate voltage having a desired falling slope; and a gate driver for receiving said gate voltage, a gate start pulse and a gate output enable signal to generate at least one gate pulse having a desired falling slope.

In the liquid crystal display, said gate driver includes an AND gate supplied with said gate start pulse; an inverter for receiving said gate output enable signal and inverting the received gate output enable signal to apply it to the AND gate; a first switching device turned on by a first control signal from the AND gate; and a second switching device turned on by a second control signal from the AND gate.

Said AND gate generates said first control signal when said inverted gate output enable signal and said gate start pulse have a high logic while generating said second control signal at the remaining time.

Said first switching device receives said gate voltage while said second switching device receives a voltage lower than said gate voltage.

A liquid crystal display according to still another aspect of the present invention includes a pulse voltage generator for receiving a gate shift clock signal to generate at least one gate voltage having a desired falling slope; and a gate driver for receiving said gate voltage, a gate start pulse and a gate output enable signal to generate a first gate pulse having a rectangular waveform and a second gate pulse having a desired slope.

In the liquid crystal display, said gate driver includes an AND gate supplied with said gate start pulse; an inverter for receiving said gate output enable signal and inverting the received gate output enable signal to apply it to the AND gate; a first switching device turned on by a first control signal from the AND gate; and a second switching device turned on by a second control signal from the AND gate.

Said AND gate generates said first control signal when said inverted gate output enable signal and said gate start pulse have a high logic while generating said second control signal at the remaining time.

Said first switching device receives said gate voltage while said second switching device receives a voltage lower than said gate voltage.

The liquid crystal display further includes a modified shift clock generator for receiving said gate shift clock signal and generating a modified gate shift clock signal remaining at a high state during two and one half period of said gate shift clock signal while remaining at a low state during a half period of said gate clock signal to apply it to the pulse voltage generator.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 8:
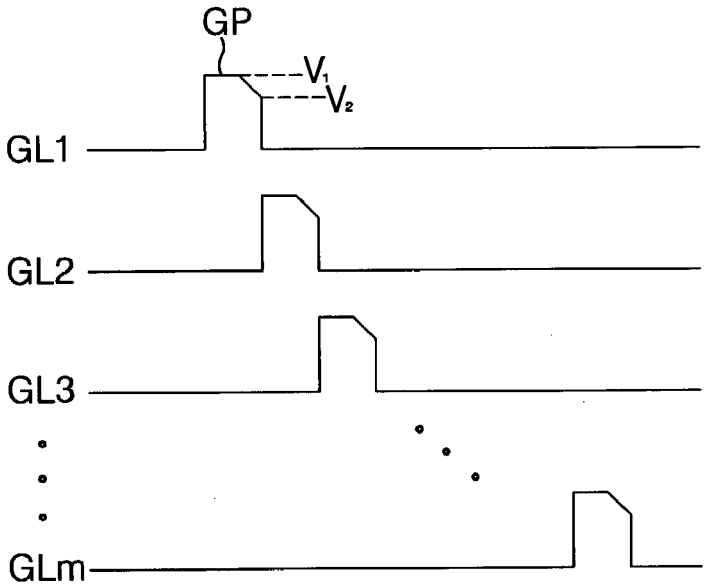
FIG. 8 is a waveform diagram of a gate pulse according to a first embodiment of the present invention.

FIG. 8 shows a method of driving a liquid crystal display according to a first embodiment of the present invention.

Figure 9:
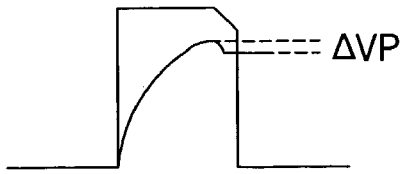
FIG. 9 shows a voltage drop. occurring upon the gate pulse shown in FIG. 8.

Referring to FIG. 8, gate pulses GP falling at a desired slope are sequentially applied to gate lines GL of the LCD. The gate pulses GP fall at a desired slope from a first voltage V1 until a second voltage V2, and suddenly fall at less than the second voltage V2. If the gate pulse GP falls at a desired slope, then a voltage drop ΔV of the liquid crystal cell is minimized as shown in FIG. 9.

In other words, if the gate pulse GP falls at a desired slope, then a voltage charged in the liquid crystal cell also drops at a desired slope to thereby lower a drop voltage ΔV of the liquid crystal cell. In the first embodiment of the present invention, the drop voltage ΔV of the liquid crystal cell is lowered, thereby improving picture quality of the LCD.

Hereinafter, a generation procedure of a driving waveform according to the first embodiment of the present invention will be described in detail with reference to FIG. 10 and FIG. 11.

Figure 10:
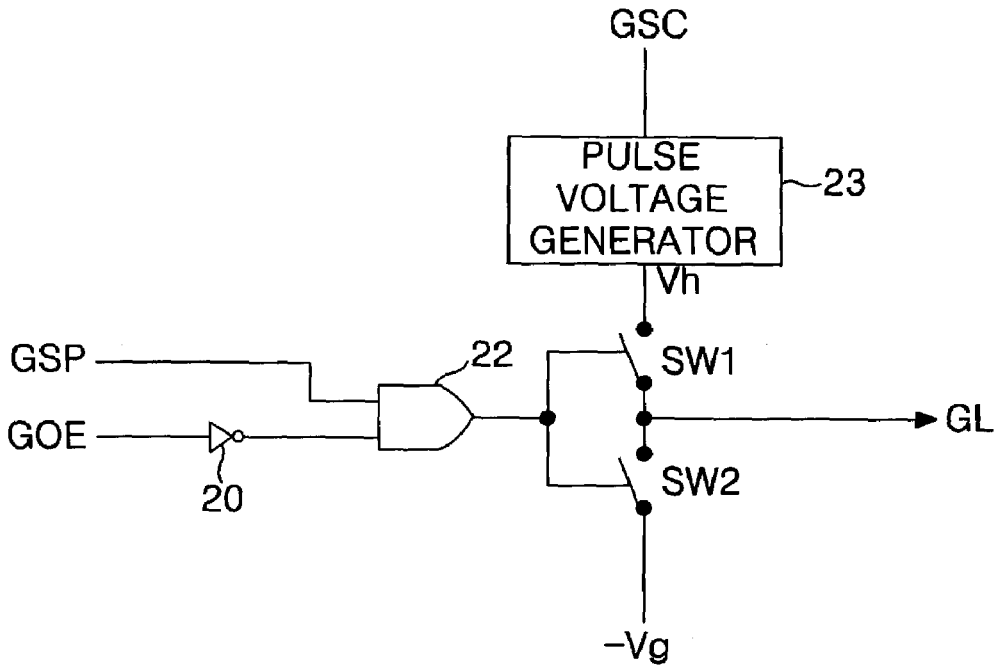
FIG. 10 is a block circuit diagram showing a configuration of a data driver integrated circuit according to an embodiment of the present invention.
Figure 11:
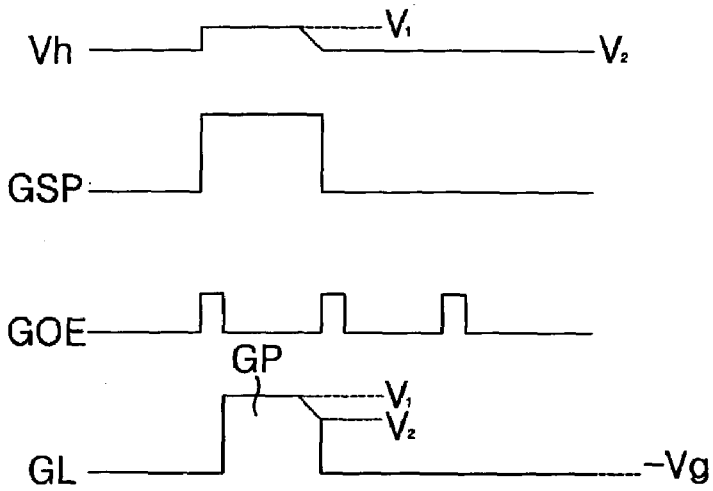
FIG. 11 is a waveform diagram showing a procedure in which the gate pulse shown in FIG. 8 is generated.

FIG. 10 is a detailed block circuit diagram showing a configuration of the driver IC according to an embodiment of the present invention.

Referring to FIG. 10, the D-IC includes an inverter 20 supplied with a gate output enable signal GOE, an AND gate 22 supplied with an output signal of the inverter 20 and a gate start pulse GSP, and first and second switching devices SW1 and SW2 controlled by an output signal of the AND gate 22.

The first switching device SW1 is connected to the pulse voltage generator 23. The pulse voltage generator 23 receives a gate shift clock signal GSC to generate a first gate voltage Vh as shown in FIG. 11. The second switching device SW2 is connected to a second gate voltage −Vg. The first gate voltage Vh generated at the pulse voltage generator 23 drops at a desired falling slope.

In other words, the first gate voltage Vh drops from a first voltage V1 into a second voltage V2 at a desired slope. Herein, the first voltage V1 can be set to 25V while the second voltage V2 can be set to 15V. The second voltage −Vg can be set to a low voltage, e.g., a direct current voltage of −5V.

The AND gate 22 receives a gate start pulse GSP and a gate output enable signal GOE inverted by the inverter 20. At this time, the AND gate 22 applies a control signal of "1" to the first and second switching devices SW1 and SW2 when the gate start pulse GSP has a high state and when the gate output enable signal GOE passing through the inverter 20 has a high state. If a control signal of "1" is applied from the AND gate 22, then the first switching device SW1 is turned on to thereby apply the first gate voltage Vh to the gate line GL.

Thereafter, the AND gate 22 applies a control signal of "0" to the first and second switching devices SW1 and SW2 when the gate start pulse GSP2 has a low state or when the gate output enable signal GOE passing through the inverter 20 has a low state. If a control signal of "0" is applied from the AND gate 22, then the second switching device SW2 is turned on to thereby apply the second gate voltage −Vg to the gate line GL. Accordingly, a gate pulse GP having a desired slope in a falling edge is applied to the gate line GL as shown in FIG. 11.

Figure 12:
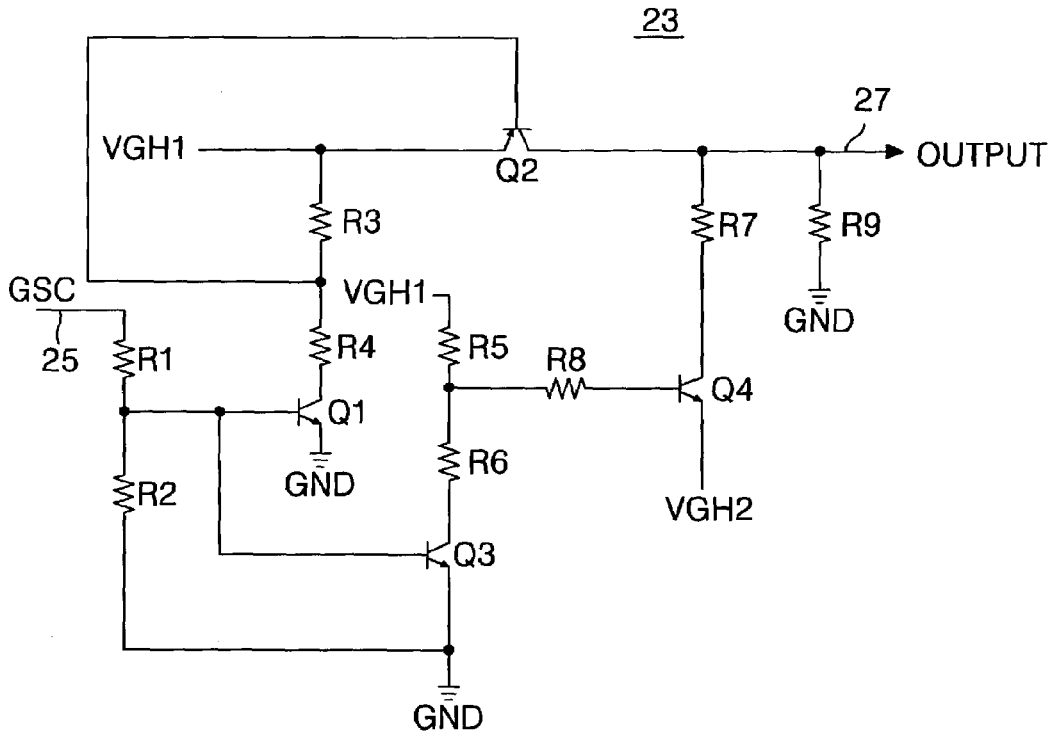
FIG. 12 is a detailed circuit diagram of the pulse voltage generator shown FIG. 11.

FIG. 12 is a circuit diagram of the pulse voltage generator 23.

Referring to FIG. 12, the pulse voltage generator 23 includes first and second resistors R1 and R2 connected, in series, between an input terminal 25 supplied with a gate shift clock signal GSC and a ground voltage source GND, a first transistor Q1 commonly connected to the first and second resistors R1 and R2, third and fourth resistors R3 and R4 connected, in series, between the first transistor Q1 and a first voltage source VGH1, a second transistor Q2 commonly connected to the third and fourth resistors R3 and R4, a third transistor Q3 connected to the first transistor Q1, fifth and sixth resistors R5 and R6 connected, in series, between the third transistor Q3 and the first voltage source VGH1, an eighth resistors R8 commonly connected to the fifth and sixth resistors R5 and R6, a seventh resistor R7 connected between the fourth transistor Q4 and the second transistor Q2, a ninth resistor R9 provided between the second transistor Q2 and the ground voltage source GND, and an output terminal 27 connected to the ninth resistor R9.

An operation procedure when the gate shift clock signal GSC is inputted to the pulse voltage generator 23 will be described in detail below.

First, if the gate shift clock signal GSC is inputted, a desired voltage is applied to the base terminals of the first and third transistors Q1 and Q3 to turn on the first transistor Q1 and the third transistor Q3. If the third transistor Q3 is turned on, then a current path involving the fifth resistor R5, the sixth resistor R6 and the ground voltage source GND is formed. At this time, the fifth and sixth resistors R5 and R6 used as a voltage-dividing resistor divide a voltage of the first voltage source VH1. Herein, resistance values of the fifth and sixth resistors R5 and R6 are set such that a voltage value equal to a voltage value of a second voltage source VGH2 can be applied. For example, if a voltage value of the first voltage source VGH1 is set to 25V while a voltage value of the second voltage source VGH2 is set to 15V, then a voltage of 15V is applied to the sixth resistor R6. Thus, the fourth transistor Q4 in which the same voltage is applied to the emitter and the base thereof keeps a turn-off state.

Meanwhile, if the first transistor Q1 is turned on, then a current path involving the third resistor R3, the fourth resistor R4 and the ground voltage source GND is formed. At this time, the third resistor R3 and the fourth resistor R4 used as a voltage-dividing resistor divide a voltage of the first voltage source VGH1. Herein, resistance values of the third resistor R3 and the fourth resistor R4 are set such that a voltage value about 1V lower than the first voltage source VGH1 can be applied to the third resistor R3. In other words, assuming that a voltage value of the first voltage source VGH1 should be 25V, a voltage of about 24V is applied to the third resistor R3. If a voltage value lower than the first voltage source VGH1 is applied, then the second transistor Q2 is turned on because a voltage difference between the base terminal and the emitter terminal of the second transistor Q2 is higher than a threshold voltage.

If the second transistor Q2 is turned on, then a voltage value of the first voltage source VGH1 is applied to the seventh resistor R7, and the voltage value applied to the seventh resistor R7 is applied to the output terminal 27. In other words, the pulse voltage generator 23 outputs a voltage V1 (i.e., VGH1) with respect to the first gate voltage Vh as shown in FIG. 11 when the gate shift clock signal GSC is applied.

An operation procedure when the gate shift clock signal GSC is not inputted to the pulse voltage generator 23 will be described in detail below.

First, if the gate shift clock signal GSC is not inputted, a voltage is not applied to the base terminals of the first and third transistors Q1 and Q3. Thus, the first and third transistors Q1 and Q3 maintain a turn-off state. If the first transistor Q1 is turned off, then a voltage of the first voltage source VGH1 is applied to the third resistor R3. At this time, the second transistor Q2 having the base terminal and the emitter terminal supplied with the same voltage maintains a turn-off state.

Meanwhile, if the third transistor Q3 is turned off, then a voltage of the first voltage source VGH1 is applied to the fifth resistor R5 and the eighth resistor R8. At this time, the fifth resistor R5 and the eighth resistor R8 used as voltage-dividing resistors divide a voltage of the first voltage source VGH1. Herein, resistance values of the fifth resistor R5 and the eighth resistor R8 are set such that a voltage value of about 1V higher than the second voltage source VGH2 can be applied to the eighth resistor R8. In other words, assuming that a voltage value of the second voltage source VGH2 should be 15V, a voltage of about 16V is applied to the eighth resistor R8. If a voltage value higher than the second voltage source VGH2 is applied, then the fourth transistor Q4 is turned on. If the fourth transistor Q4 is turned on, then a voltage of the second voltage source VGH2 is applied to the seventh resistor R7. At this time, a voltage applied to the seventh resistor R7 is applied to the output terminal 27.

In other words, a voltage outputted to the exterior drops from a voltage of the first voltage source VGH1 into a voltage of the second voltage source VGH2. At this time, such a voltage drop is developed from a voltage of the first voltage source VGH1 into a voltage of the second voltage source VGH2 as shown in FIG. 11 by capacitance components and resistance components of the lines.

Figure 13A:
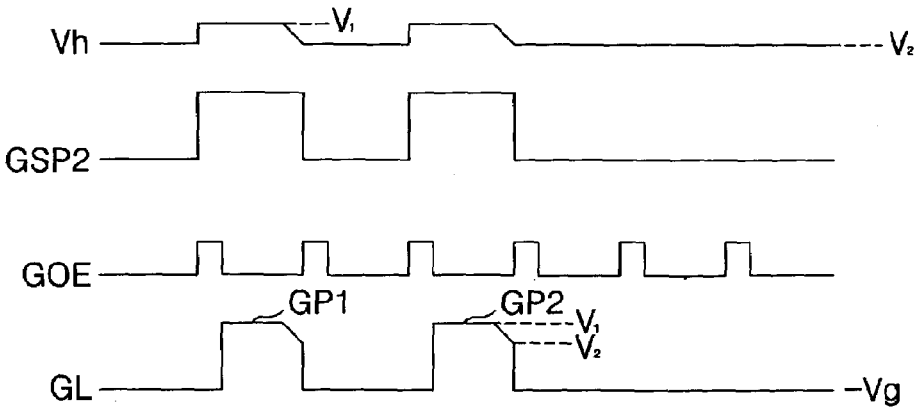
FIG. 13A and FIG. 13B are waveform diagrams of gate pulses according to a second embodiment of the present invention.
Figure 13B:
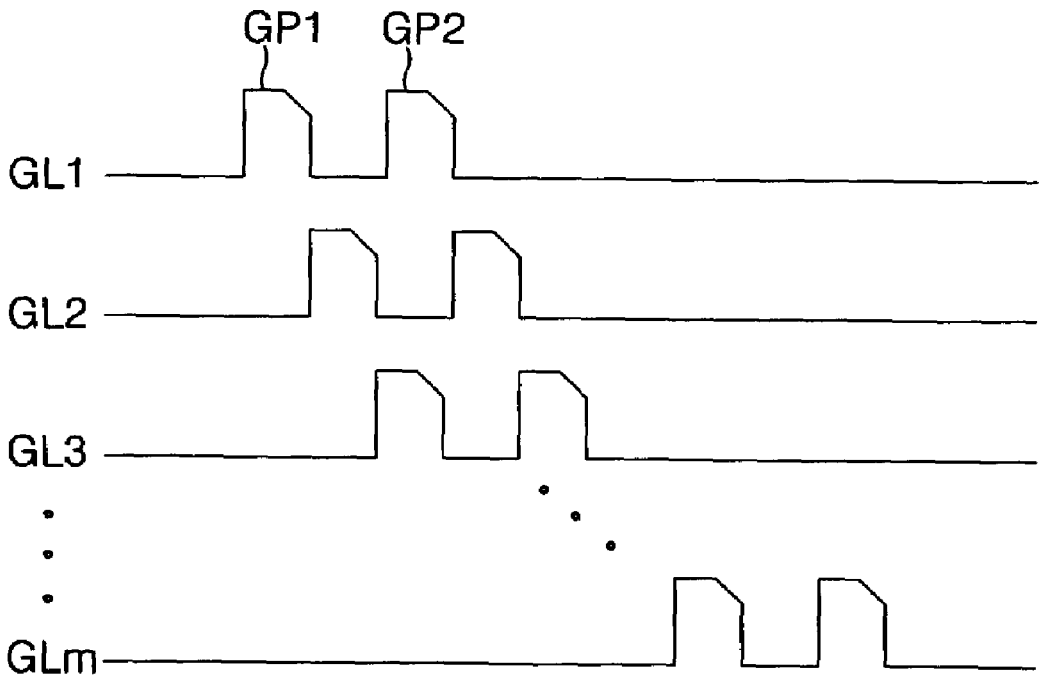

FIG. 13A and FIG. 13B shows a method of driving a liquid crystal display according to a second embodiment of the present invention.

Referring to FIG. 13A and FIG. 13B, in the second embodiment of the present invention, first and second gate pulses GP1 and GP2, each having a desired falling slope, are applied to the gate line GL being spaced by one horizontal synchronizing signal. More specifically, when the second gate pulse GP2 is applied to the first gate line GL1, the first gate pulse GP1 is applied to the third gate line GL3. At this time, a desired voltage corresponding to a video signal is charged in the first gate line GL1. On the other hand, a voltage corresponding to a video signal at the first gate line GL1 is pre-charged in the third gate line GL3 supplied with the first gate pulse GP1.

For instance, if a voltage signal having a voltage of 5V is applied when the second gate pulse GP2 is applied to the first gate line GL1, then a voltage of 5V is precharged in the liquid crystal cells provided along the third gate line GL3.

Thereafter, if a video signal having a voltage of 7V is applied when the second gate pulse GP2 is applied to the third gate line GL3, then only a voltage of 2V is charged in the liquid crystal cells provided along the third gate line GL3. In other words, in the LCD driving method according to the second embodiment, when the first gate pulse GP1 is applied to the nth gate line GLn, a voltage corresponding to a video signal applied to the (n−2)th gate line GLn−2 is pre-charged to thereby charge a desired voltage irrespectively of the location of the liquid crystal cell. Further, since the first and second gate pulses GP1 and GP2 fall at a desired slope, a voltage drop phenomenon at the liquid crystal cell can be minimized.

Meanwhile, the first and second gate pulses GP1 and GP2 applied to the gate line GL can be generated by means of the D-IC shown in FIG. 10. Herein, the pulse voltage generator 23 generates two pulse signals Vh as shown in FIG. 13 to apply them to the first switch SW1. Further, two gate start pulse GSP2 applied to the AND gate 22 are generated by means of the flip-flop circuit shown in FIG. 4. As mentioned above, the pulse signal Vh generated from the pulse voltage generator 23 is applied to the first switch SW1 and two gate start pulses GSP are applied to the AND gate 22, thereby generating the first and second gate pulses GP1 and GP2 each having a desired slope.

Figure 14:
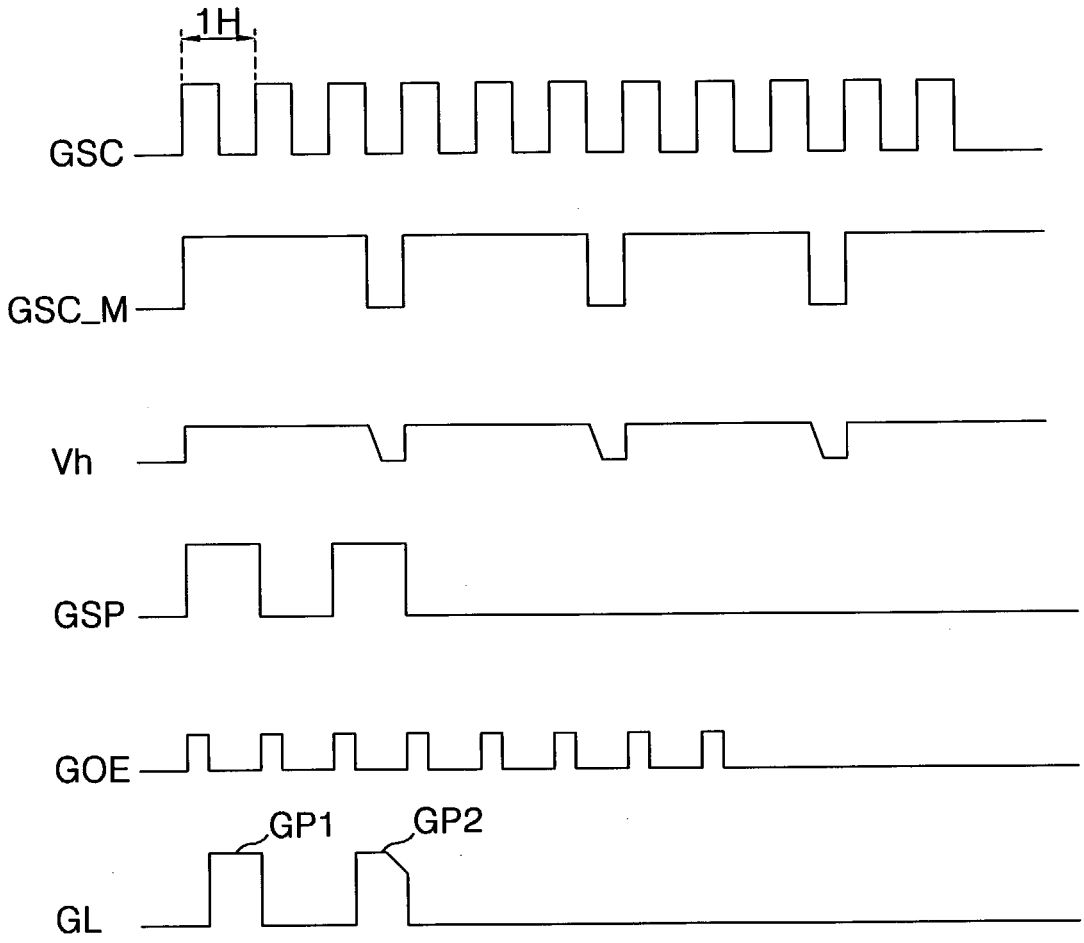
FIG. 14 is a waveform diagram of a gate pulse according to a third embodiment of the present invention.

FIG. 14 shows a method of driving a liquid crystal display according to a third embodiment of the present invention.

Referring to FIG. 14, in the third embodiment of the present invention, a first gate pulse GP1 falling without any slope and a second gate pulse GP2 falling at a desired slope are applied to the gate line GL at an interval of one horizontal period. The second gate pulse GP2 is used for charging a video signal applied from the data line. The first gate pulse GP1 is used for pre-charging a desired voltage.

In the third embodiment, since a desired voltage is pre-charged when the first gate pulse GP1 is applied, a desired voltage can be charged irrespectively of a location of the liquid crystal display. Further, since the second gate pulse GP2 falls at a certain slope, a voltage drop phenomenon at the liquid crystal cell can be minimized.

Meanwhile, the first and second gate pulses GP1 and GP2 applied to the gate line GL can be generated by means of the D-IC shown in FIG. 10. Herein, the pulse voltage generator 23 generates a pulse signal remaining at a high state during two and one half periods and falling at a certain slope during a half period.

Figure 1:
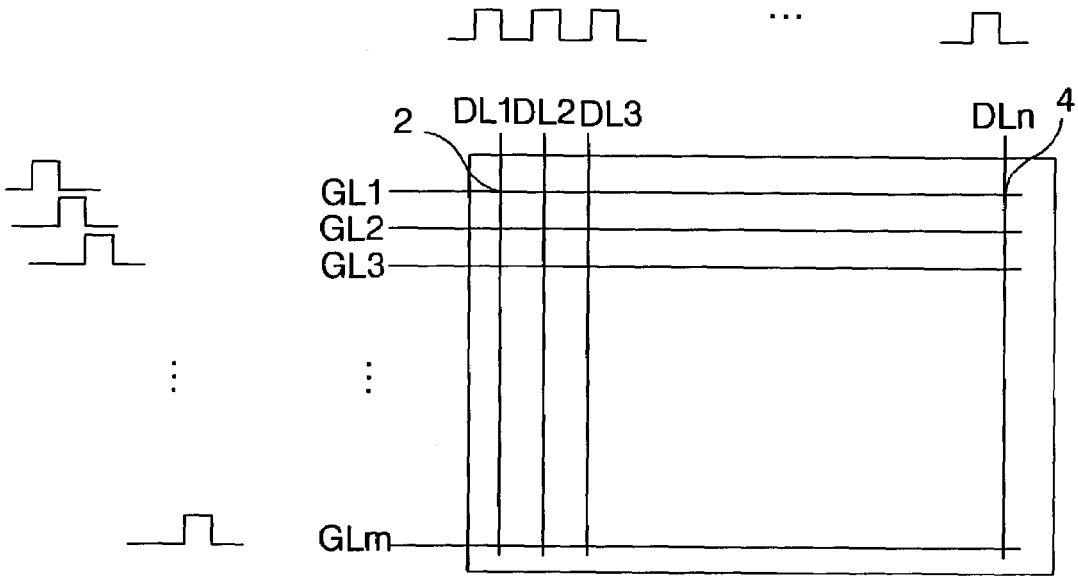
FIG. 1 RELATED ART
FIG. 1 depicts gate lines and data lines of a conventional liquid crystal display.
Figure 2A:
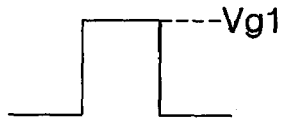
FIG. 2A RELATED ART
FIG. 2A and FIG. 2B are waveform diagrams of gate pulses applied to the gate lines.
Figure 2B:
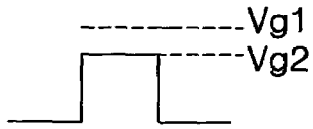
FIG. 2B RELATED ART
Figure 3:
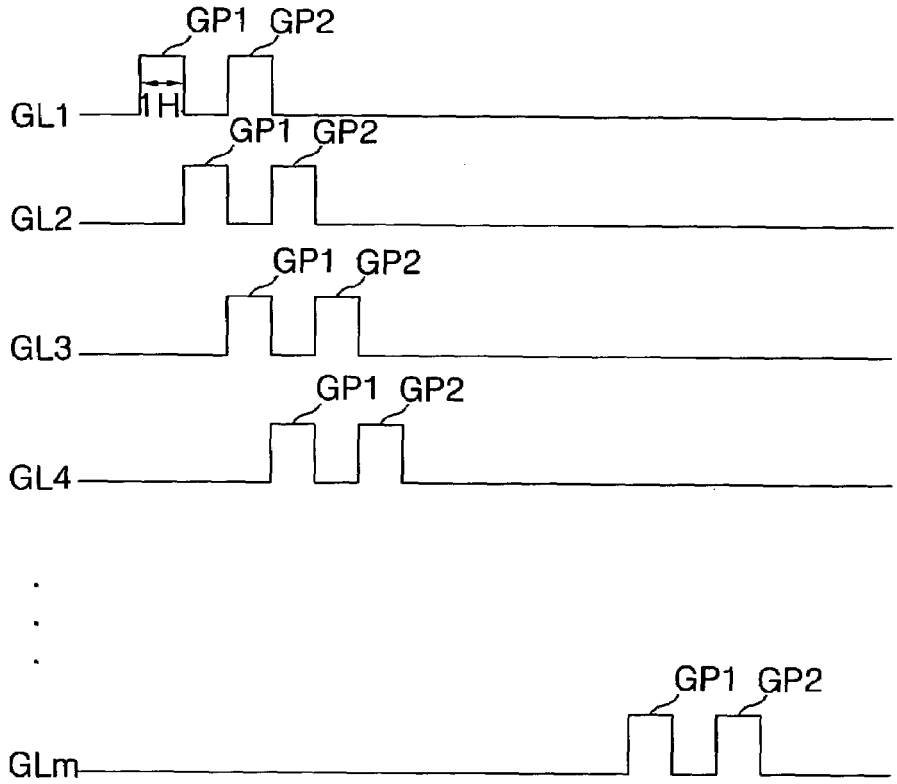
FIG.3 RELATED ART
FIG. 3 is a waveform diagram of a gate pulse according to another conventional liquid crystal display.
Figure 4:
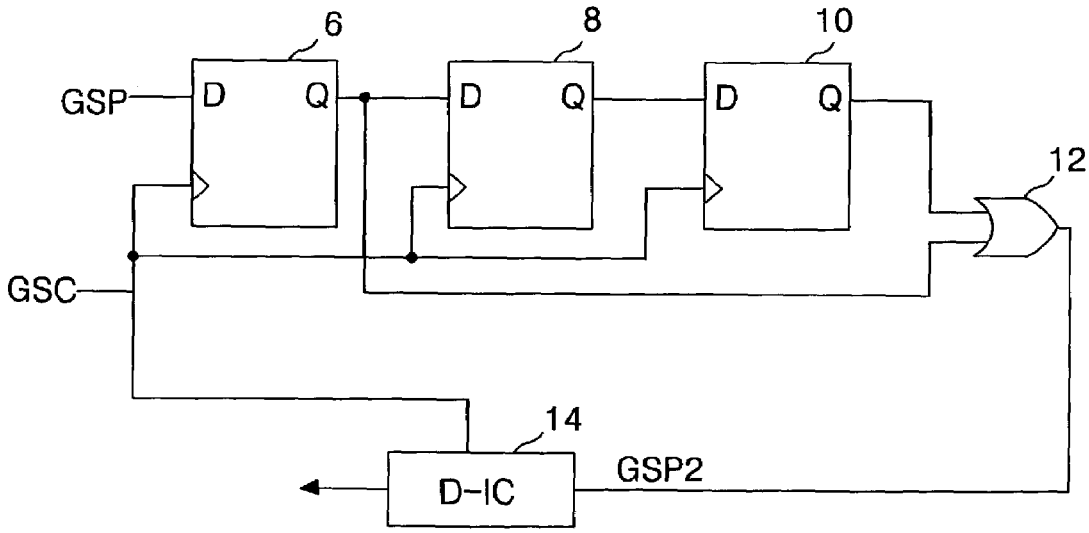
FIG.4 RELATED ART
FIG. 4 is a detailed circuit diagram of a driver for generating the gate pulse shown in FIG. 3.
Figure 5:
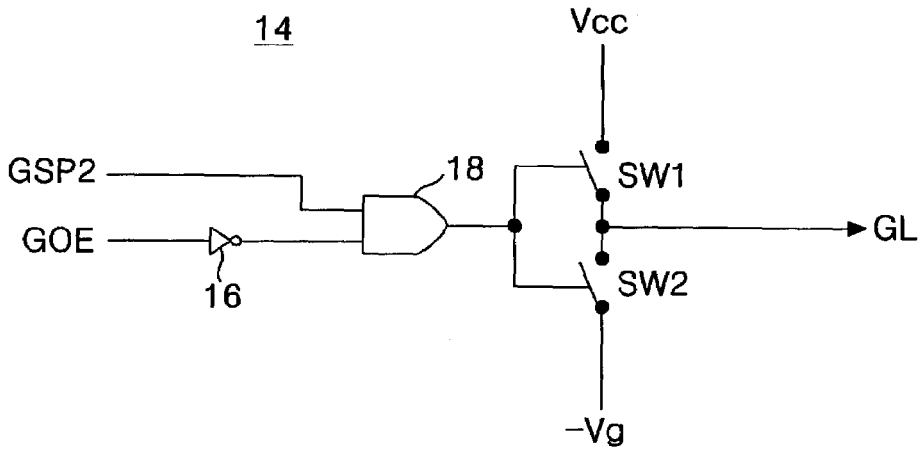
FIG.5 RELATED ART
FIG. 5 is a detailed circuit diagram of the driver integrated circuit shown in FIG. 4.
Figure 6:
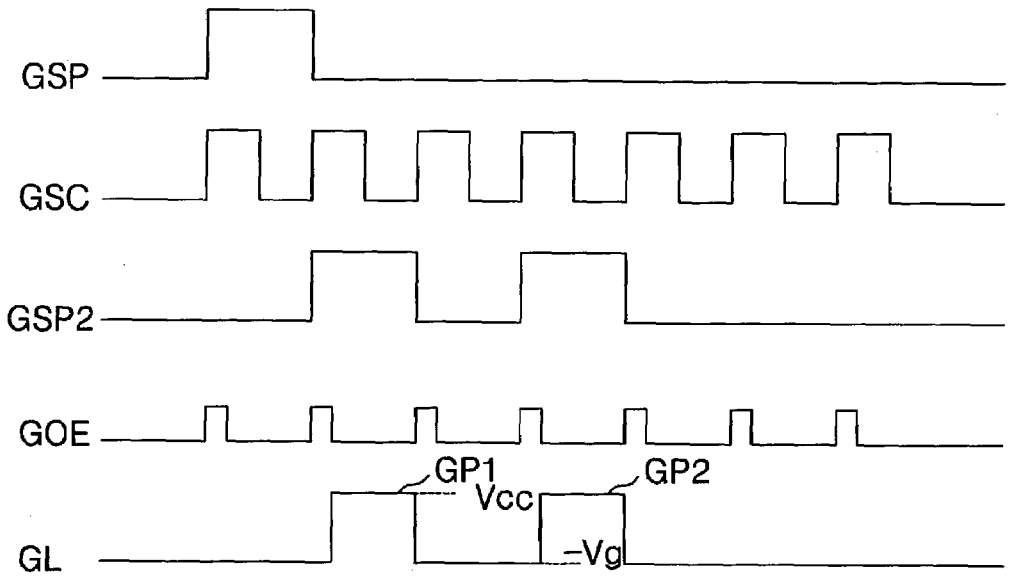
FIG.6 RELATED ART
FIG. 6 is a waveform diagram showing a procedure in which the gate pulse shown in FIG. 3 is generated.
Figure 7:
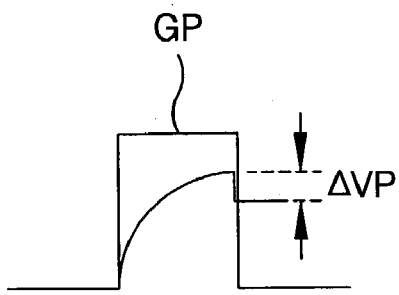
FIG. 7 RELATED ART
FIG. 7 shows a voltage drop occurring upon falling of the gate pulse shown in FIG. 3.

Further, two gate start pulse GSP2 applied to the AND gate 22 are generated by means of the flip-flop circuit shown in FIG. 4. As mentioned above, the pulse signal Vh generated from the pulse voltage generator 23 is applied to the first switch SW1 and two gate start pulses GSP are applied to the AND gate 22, thereby generating the first and second gate pulses GP1 and GP2. Meanwhile, in order to generate the pulse signal Vh shown in FIG. 14, a modified gate shift clock GSC_M remaining at a high state during two and one half periods of the gate shift clock GSC while remaining at a high state during a half period is applied to the pulse voltage generator 23. The modified gate shift clock GSC_M is provided at the previous stage of the pulse voltage generator 23 as shown in FIG. 15.

Figure 15:
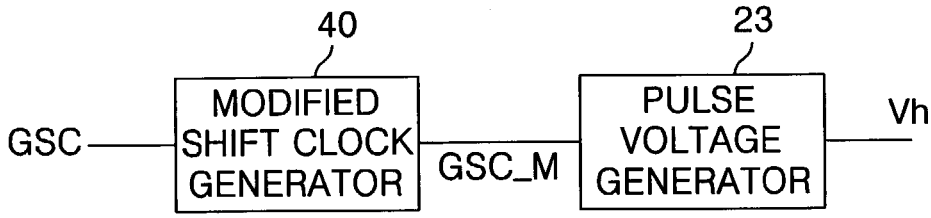
FIG. 15 is a block diagram of a configuration for generating a modified gate shift clock shown in FIG. 14.

Referring to FIG. 15, a modified shift clock generator 40 is supplied with a gate shift clock signal GSC. The modified shift clock generator 40 having been supplied with the gate shift clock signal GSC generates a modified gate shift clock signal GSC_M by utilizing the gate shift clock-signal GSC. The modified gate shift clock signal GSC_M generated at the modified shift clock generator 40 is inputted to the pulse voltage generator 23. Thereafter, the pulse voltage generator 23 generates the pulse signal Vh shown in FIG. 14 by utilizing the modified gate shift clock signal GSC_M.

As described above, according to the present invention, a gate pulse falls at a desired slope. Accordingly, a drop of a voltage charged in the liquid crystal cell is minimized, thereby improving the quality of a picture displayed at the liquid crystal cell.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal display having a plurality of liquid crystal cells arranged in a matrix type, said method comprising the steps of:

providing a gate driver for receiving a gate voltage from a pulse voltage generator, a gate start pulse and a gate output enable signal to generate at least one gate pulse having a desired falling slope;

applying video signals to a plurality of data lines connected to the liquid crystal cells; and sequentially applying the at least one gate pulse having the desired falling slope to a plurality of gate lines connected to the liquid crystal cells in a direction crossing the data lines, wherein the pulse voltage generator is directly connected to a first switching device of the gate driver, and wherein the pulse voltage generator includes:

first and second resistors connected, in series, between an input terminal supplied with a gate shift clock signal and a ground voltage source, a first transistor commonly connected to the first and second resistors;

third and fourth resistors connected,in series, between the first transistor and a first voltage source;

a second transistor commonly connected to the third and fourth resistors;

a third transistor connected to the first transistor;

fifth and sixth resistors connected, in series, between the third transistor and the first voltage source;

an eighth resistor commonly connected to the fifth and sixth resistors;

a seventh resistor connected between a fourth transistor and the second transistor;

a ninth resistor provided between the second transistor and the ground voltage source; and an output terminal connected to the ninth resistor.

2. The method as claimed in claim 1, wherein said gate pulse includes the steps of:

rising from a first voltage into a second voltage;

remaining at said second voltage;

falling from said second voltage into a third voltage higher than said first voltage at a desired slope; and falling from said third voltage into said first voltage.

3. The method as claimed in claim 1, wherein first and second gate pulses of the at least one pulse having the desired falling slope are applied to the gate lines in such a manner to be spaced by one horizontal period.

4. The method as claimed in claim 3, wherein the second gate pulse applied to the nth gate line (wherein n is an integer) and the first gate pulse applied to the (n+2)th gate line are applied substantially at the same time.

5. A method of driving a liquid crystal display having a plurality of liquid crystal cells arranged in a matrix type, said method comprising the steps of:

applying video signals to a plurality of data lines connected to the liquid crystal cells;

applying a first gate pulse having a desired falling slope to any one of a plurality of gate lines connected to the liquid crystal cells in a direction crossing the data lines; and applying a second gate pulse having a rectangular waveform to the gate line supplied with the first gate pulse in such a manner to be spaced by one horizontal period from the first gate pulse.

6. The method as claimed in claim 5, wherein the first gate pulse applied to the nth gate line (wherein n is an integer) and the second gate pulse applied to the (n+2)th gate line are applied at the same time.

7. The method as claimed in claim 5, wherein said first gate pulse includes the steps of:

rising from a first voltage into a second voltage;

remaining at said second voltage;

falling from said second voltage into a third voltage higher than said first voltage at a desired slope; and falling from said third voltage into said first voltage.

8. A liquid crystal display, comprising:

a pulse voltage generator for receiving a gate shift clock signal to generate at least one gate voltage having a desired falling slope; and a gate driver for receiving said gate voltage, a gate start pulse and a gate output enable signal to generate at least one gate pulse having a desired falling slope, wherein the pulse voltage generator is directly connected to a first switching device of the gate driver, and wherein the pulse voltage generator includes:

first and second resistors connected, in series, between an input terminal supplied with a gate shift clock signal and a around voltage source, a first transistor commonly connected to the first and second resistors;

third and fourth resistors connected, in series, between the first transistor and a first voltage source;

a second transistor commonly connected to the third and fourth resistors;

a third transistor connected to the first transistor;

fifth and sixth resistors connected, in series, between the third transistor and the first voltage source;

an eighth resistor commonly connected to the fifth and sixth resistors;

a seventh resistor connected between a fourth transistor and the second transistor;

a ninth resistor provided between the second transistor and the ground voltage source; and an output terminal connected to the ninth resistor.

9. The liquid crystal display as claimed in claim 8, said gate driver includes:

an AND gate supplied with said gate start pulse;

an inverter for receiving said gate output enable signal and inverting the received gate output enable signal to apply it to the AND gate; and a second switching device turned on by a second control signal from the AND gate, wherein the first switching device is turned on by a first control signal from the AND gate.

10. The liquid crystal display as claimed in claim 9, wherein said AND gate generates said first control signal when said inverted gate output enable signal and said gate start pulse have a high logic while generating said second control signal at the remaining time.

11. The liquid crystal display as claimed in claim 9, wherein said first switching device receives said gate voltage while said second switching device receives a voltage lower than said gate voltage.

12. A liquid crystal display, comprising:

a pulse voltage generator for receiving a gate shift clock signal to generate at least one gate voltage having a desired falling slope; and a gate driver for receiving said gate voltage, a gate start pulse and a gate output enable signal to generate a first gate pulse having a rectangular waveform and a second gate pulse having a desired slope.

13. The liquid crystal display as claimed in claim 12, wherein said gate driver includes:

an AND gate supplied with said gate start pulse;

an inverter for receiving said gate output enable signal and inverting the received gate output enable signal to apply it to the AND gate;

a first switching device turned on by a first control signal from the AND gate; and a second switching device turned on by a second control signal from the AND gate.

14. The liquid crystal display as claimed in claim 13, wherein said AND gate generates said first control signal when said inverted gate output enable signal and said gate start pulse have a high logic while generating said second control signal at the remaining time.

15. The liquid crystal display as claimed in claim 13, wherein said first switching device receives said gate voltage while said second switching device receives a voltage lower than said gate voltage.

16. The liquid crystal display as claimed in claim 12, further comprising:

a modified shift clock generator for receiving said gate shift clock signal and generating a modified gate shift clock signal remaining at a high state during two and one half period of said gate shift clock signal while remaining at a low state during a half period of said gate clock signal to apply it to the pulse voltage generator.

* * * * *